United States Patent [19]

Williams

[11] Patent Number: 4,993,782

[45] Date of Patent: Feb. 19, 1991

[54] SWIVEL SEWING MACHINE CABINET

[75] Inventor: Kenneth J. Williams, Sutton, W. Va.

[73] Assignee: IMC Corporation of America, Sutton, W. Va.

[21] Appl. No.: 360,301

[22] Filed: Jun. 2, 1989

[51] Int. Cl.[5] ..... A47B 81/00

[52] U.S. Cl. ..... 312/21; 312/282; 312/314

[58] Field of Search ..... 312/282, 317.1, 314, 312/21; 180/91, 17

[56] References Cited

U.S. PATENT DOCUMENTS

| | | | |
|---|---|---|---|
| 896,664 | 8/1908 | Rausch | 312/282 |
| 1,195,964 | 8/1916 | Bradley | 312/314 |
| 1,227,536 | 5/1917 | Hartman | 312/314 X |
| 1,272,587 | 7/1918 | Wells | 312/314 X |
| 1,881,475 | 10/1932 | Gibson | 108/91 X |
| 2,198,467 | 4/1940 | Wardwell | 312/314 X |
| 2,587,469 | 2/1952 | Herring | 312/21 X |
| 3,427,666 | 2/1969 | Saxe | 312/314 X |

*Primary Examiner*—Joseph Falk

*Attorney, Agent, or Firm*—Charles F. Duffield

[57] ABSTRACT

Improvements to standard sewing machine cabinets are disclosed which provide for use of an additional sewing machine such as a serger. The improvements include a swivel panel secured to a side panel of the sewing machine cabinet which is hinged so as to swing between a position parallel to and perpendicular to the side panel of the cabinet. A work table is hinged at one end to the top of the swivel panel and can be moved between a folded position when parallel to the swivel panel and in an erected position when in a position perpendicular to the swivel panel. When in erected position, the work table may be swiveled between straight positions in line with the cabinet top to an L position when perpendicular to the cabinet top or alternately folded away in a compact position.

3 Claims, 6 Drawing Sheets

SWIVEL SEWING MACHINE CABINET

BACKGROUND OF INVENTION

The present invention relates to sewing machine cabinets and, more particularly, to improvements in sewing machine cabinets providing for a work surface which can swivel between a straight and L position for use with such machines as sergers and also which can be quickly folded into a compact stored position when not in use.

Sewing machine cabinets of earlier years were of a configuration employing side panels and a top panel with two folding leaves. A standard freearm conventional sewing machine would be stored within the sewing machine cabinet when not in use beneath the folding leaves and, when in use, raised into an elevated position above the top panel of the sewing machine after the cabinet leaves had been unfolded.

Within recent years, there has been the introduction of the new overlock/serger sewing machines. These machines produce a professional blind hem which produces a better garment and, accordingly, such machines have become increasingly popular.

With the introduction of the serger machines, there has been a growing demand for dual machine cabinets known as Duo-cabinets. These Duo-cabinets are designed to house both the conventional sewing machine and have another work surface upon which the serger machine is positioned.

The Duo-cabinets presently available are of a fixed design in either an L configuration or a straight configuration. That is to say that, that portion of the cabinet upon which the serger is positioned, together with its associated work space, is fixed relative to the basic sewing machine cabinet within which the conventional sewing machine is positioned and, accordingly, the configuration cannot be altered nor can that portion of the cabinet provided for the serger be disassembled and folded away or stored in a compact configuration. These Duo-cabinets presently available thus require considerable room within a home environment.

What is desired in a practical working Duo-cabinet is one which can alternately be positioned in either the straight or L configuration depending upon the user's choice for use in such areas as corners for the L configuration and straight for long extended wall placement. Additionally, such a Duo-cabinet preferably is of a configuration that can be quickly and conveniently folded into a compact configuration for storage when the sewing machine cabinet is not in use.

SUMMARY OF INVENTION

The sewing machine cabinet improvements of the present invention overcome the deficiencies of Duo-cabinets heretofore available. The improvements to standard sewing machine cabinets of the present invention provide a work surface for a serger which can be swiveled between a straight position and an L position when in erected configuration. The serger may be removed from the work surface and the work surface or work table lowered to a folded configuration flat against one side panel of the cabinet.

In accordance with the present invention, a standard conventional sewing machine cabinet is utilized which employs two side panels, a top panel and two folding cabinet leaves beneath which there is stored a conventional sewing machine. In accordance with the improvements of the present invention, a swivel panel is secured by hinge means at one vertical edge adjacent the front edge of one side panel of the sewing machine cabinet. The swivel panel can be moved between a position flat against the side panel or swiveled to a position perpendicular to the side panel.

Further in accordance with the improvements of the present invention, a work table is hinged to the upper surface of the swivel panel at one end thereof. In this manner, the work table may be lowered to a position flat against the swivel panel when the swivel panel is likewise flat against the side panel to thus place the work table and swivel panel in folded configuration for storage.

In erected position, the work table may be raised to a position perpendicular to the side panel. A support panel is secured in a vertical position to the opposite end of the work table to provide support for and maintain the work table in its horizontal position.

If a straight configuration of cabinet is desired, the work table is merely swiveled upon the swivel panel to a straight position in line with the upper surface of the sewing machine cabinet. In the alternative, the work table may be swung or swiveled around upon the swivel panel to a position perpendicular to the upper surface of the sewing machine cabinet.

The swivel panel is positioned upon the side panel in a manner such that the upper surface of the work table is below the level of the cabinet leaf when in unfolded position. When the work table is swiveled around into the L position, an adapter platform is provided which will raise the elevation of the upper surface of the work table to the level of the cabinet leaf adjacent thereto. This adapter platform provides for additional work surface and also aligns with the sewing table of the serger which is positioned on the opposite end of the work table.

In an alternative form, the support panel may also take the form of a cabinet with a door. This cabinet provides a convenient place to store the serger when not in use.

In a further alternate embodiment, the sewing machine cabinet may be of the design which has one or more front doors. The swivel panel, in this case, becomes the door itself and the work table is connected to the inner surface of the door. The swivel action of this configuration works as in the embodiment wherein the swivel panel is provided.

Other objects and advantages of the improvements to sewing machine cabinets of the present invention will become apparent from the detailed description thereof which follows taken in conjunction with the drawings.

DETAILED DESCRIPTION OF INvENTION

Figure 1:
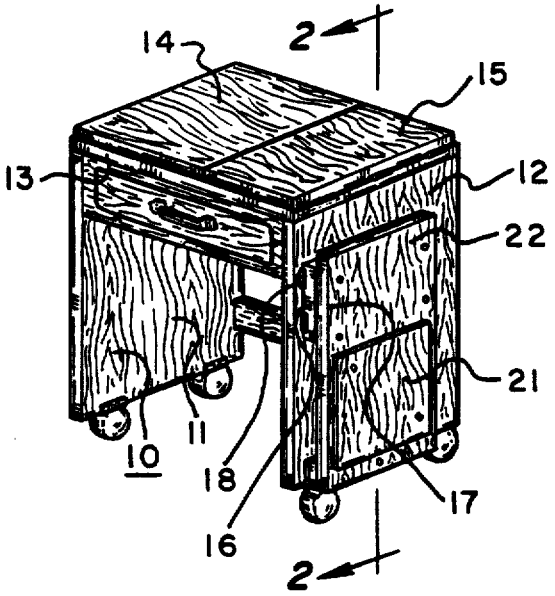
FIG. 1 is a perspective view of a conventional sewing machine cabinet with the improvements of the present invention in folded compact configuration.
Figure 2:
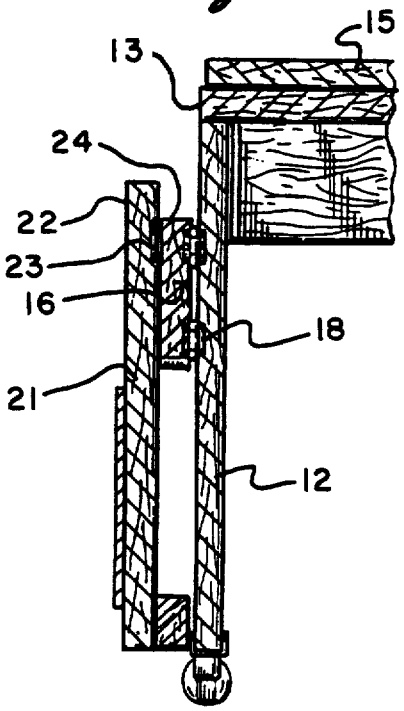
FIG. 2 is a rear sectional view through the hinges supporting the swivel panel and work table when in folded position.

FIGS. 1 and 2 of the drawings illustrate a conventional sewing machine cabinet 10 to which the improvements providing for a Duo-cabinet of the present invention are applied. The conventional sewing machine cabinet 10 includes opposed side panels 11 and 12 and an upper surface 13. The conventional cabinet further includes a left-hand cabinet leaf 14 and a right-hand cabinet leaf 15 shown in FIGS. 1 and 2 in folded or closed position.

In accordance with the improvements of the present invention, a swivel panel 16 is provided. The swivel panel 16 is essentially of a flat triangular configuration. The forward edge 17 of the swivel panel 16 is secured by a pair of hinges 18 adjacent the forward edge of the side panel 12.

A work table 21 is provided in accordance with the present invention. A first end 22 of the work table 21 is secured by hinges 23 to the upper horizontal edge 24 of the swivel panel 16.

This arrangement of the hinged swivel panel 16 and hinged work table 21 permits the swivel panel 16 to be swiveled to a position flat against the side panel 12 of the sewing machine cabinet as shown in FIGS. 1 and 2 while also permitting the hinged work table 21 to likewise lie flat against the swivel panel 16 in vertical alignment with the side panel 12 likewise as shown in FIGS. 1 and 2. In this configuration, the swivel panel and work table are in a stored compact configuration.

Figure 3:
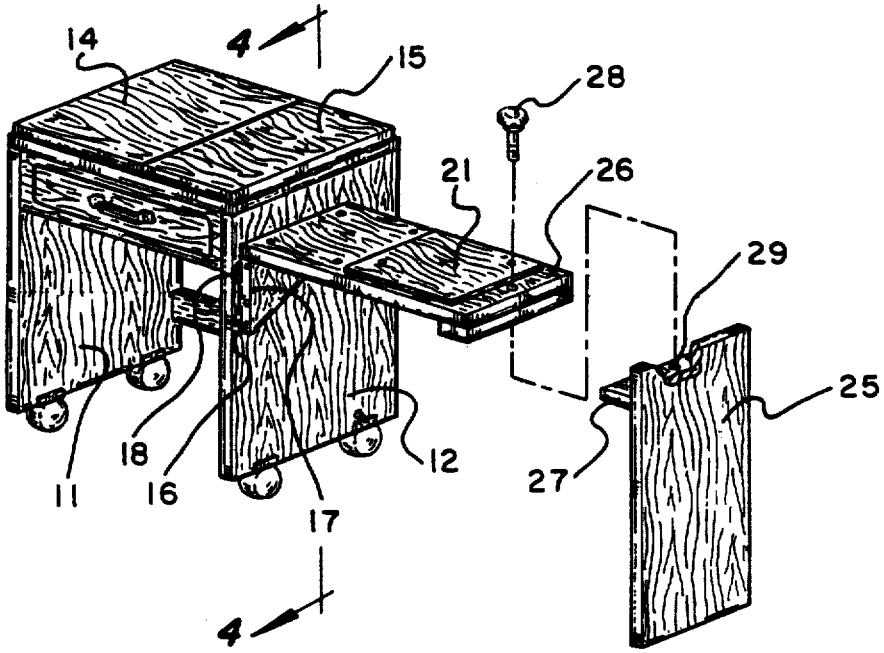
FIG. 3 is a perspective view partially exploded showing the swivel panel and work table in erected straight configuration.
Figure 4:
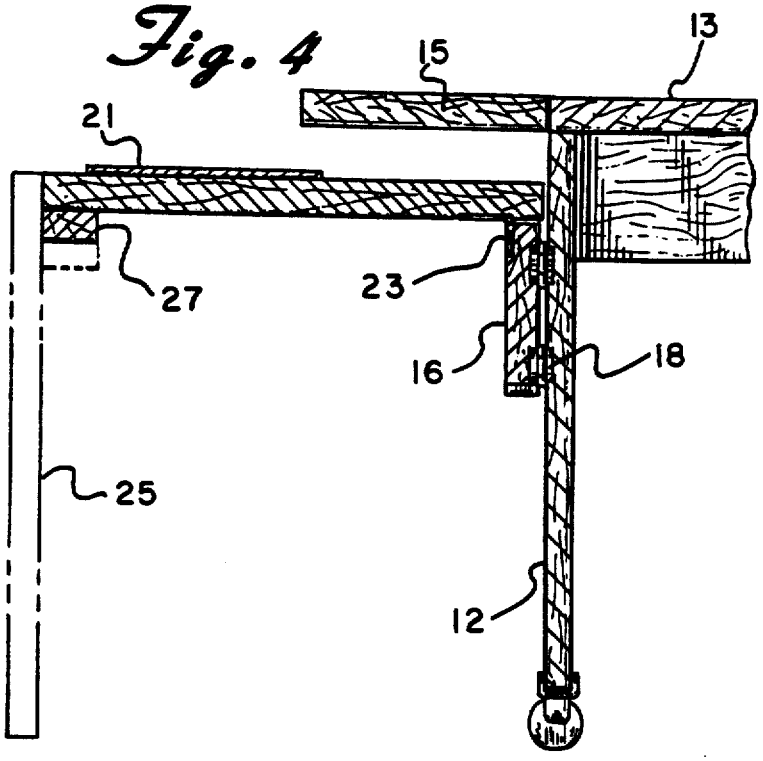
FIG. 4 is a rear sectional view through the hinges supporting the swivel panel and work table when in erected position.
Figure 5:
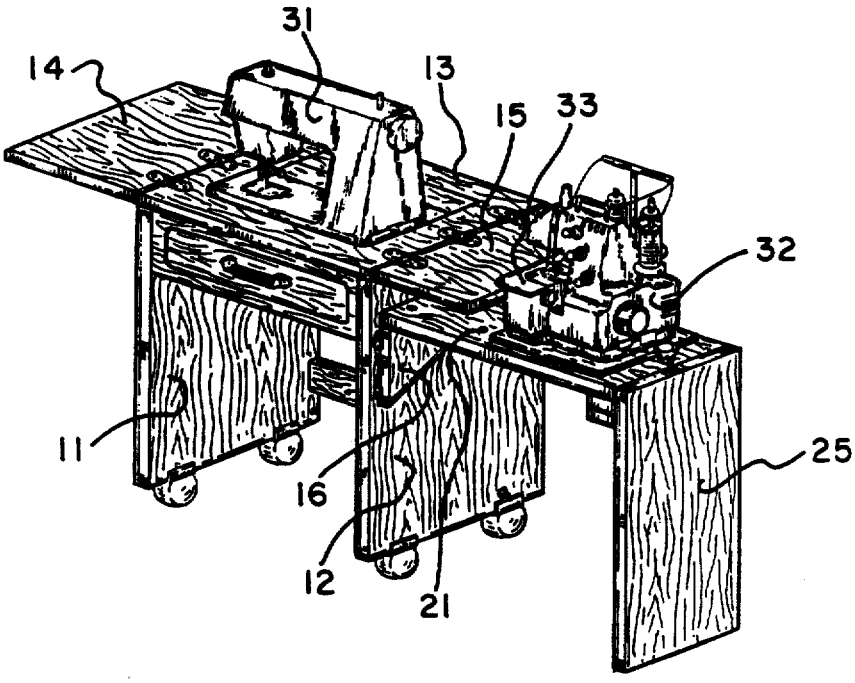
FIG. 5 is a perspective view of the sewing machine cabinet with the conventional sewing machine in erected position and the work table in erected straight configuration with a serger machine thereupon.
Figure 6:
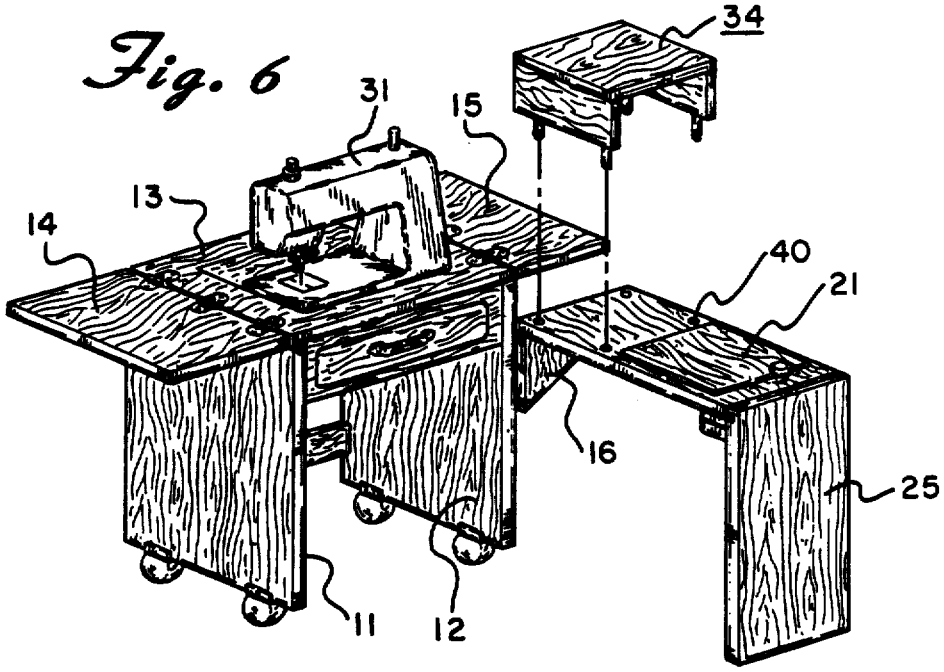
FIG. 6 is a perspective view partially exploded showing the conventional sewing machine in elevated position with the work table in L configuration together with the adapter platform.

As shown in FIGS. 3, 4 and 5, erection of the swivel panel and work table for use is accomplished simply by raising the work table 21 to its elevated position. Once in the elevated position, a support panel 25 is placed under the second end 26 of the work table 21. The support panel 25 includes a support ledge 27 thereupon upon which the second end 26 rests. A threaded connector knob 28 is utilized to pass through the work table 21 and thread into an appropriate threaded member 29 in the support ledge 27.

Once the work table is thus erected in the straight configuration as shown in FIGS. 3–5, the left-hand and right-hand cabinet leaves 14 and 15 respectively may be opened, as illustrated in FIG. 5, and the conventional sewing machine 31 brought into raised position. Thereafter, the serger machine 32 may be placed upon the work table 21 to provide a dual machine setup.

As may be seen from FIG. 5, the serger machine 32 is placed upon the right-hand side of the work platform. The work table 21 is supported upon the swivel panel 16 at a level below the unfolded right-hand cabinet leaf 15 a distance equal to the height of the serger sewing table 33. In this manner, the upper surface of the unfolded right-hand cabinet leaf 15 is in alignment with the serger sewing table 33 to provide ease of maneuvering of the fabric being sewn.

FIGS. 6–9 of the drawings illustrate the swivel panel 16, its associated work table 21 and support panel 25 swiveled around into L configuration. In this configuration, the swivel panel 16 is perpendicular to the surface of the side panel 12 while the work table 21 is likewise perpendicular to the upper surface of the sewing machine cabinet. Such a configuration is useful for placing the sewing machine cabinet and sewing machines in the corner of a room.

In accordance with the present invention, an adapter platform 34 is provided. The adapter platform 34 has an upper surface 35 and two opposed side panels 36 and 37. The side panels 36 and 37 are interconnected to the upper surface 35 by means of hinges 38.

Figure 9:
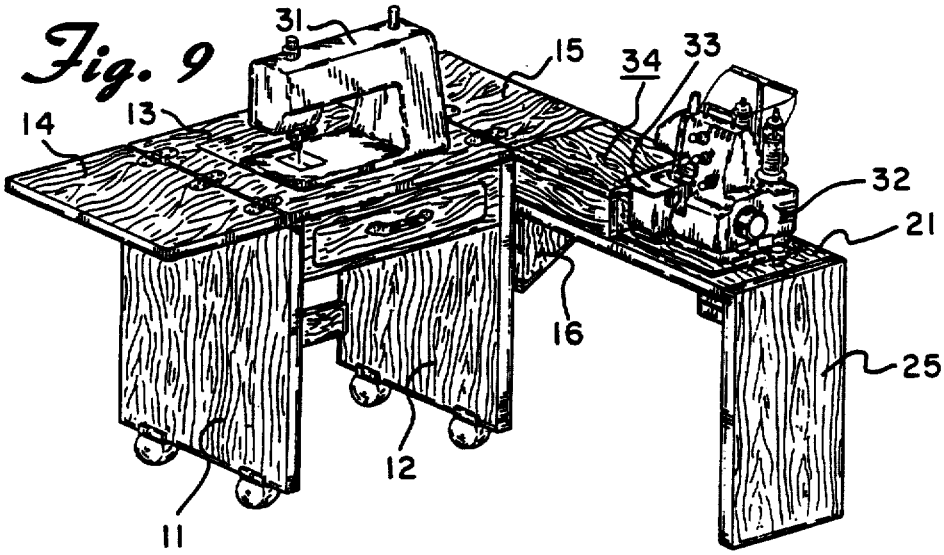
FIG. 9 is a perspective view of the conventional sewing machine in elevated position with the adapter platform in assembled position in L configuration and further illustrating a serger machine positioned upon the work table.

The adapter platform includes four dowels 39 in the bottom edges of the side panels 36 and 37. In this manner, the dowels cooperate with holes 40 in the upper surface of the work table 21 to hold the adapter platform in place. The adapter platform 34 is of a height such as to be in alignment with the upper surface of the right-hand cabinet leaf 15. In this manner and as shown in FIG. 9, when the serger is in place, the adapter platform provides additional work space and falls into alignment with the serger sewing table 33 for ease of sewing.

Figure 7:
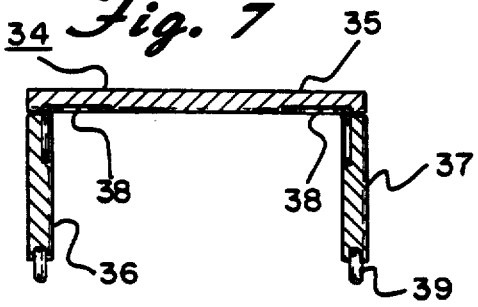
FIG. 7 is a sectional view through the adapter platform of FIG. 6.
Figure 7A:
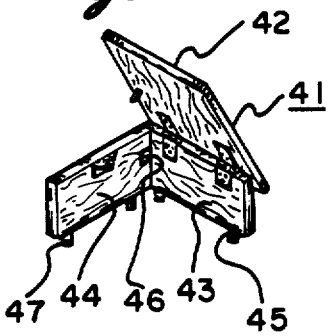
FIG. 7*a* is a perspective view of an alternate design of adapter platform.
Figure 8:
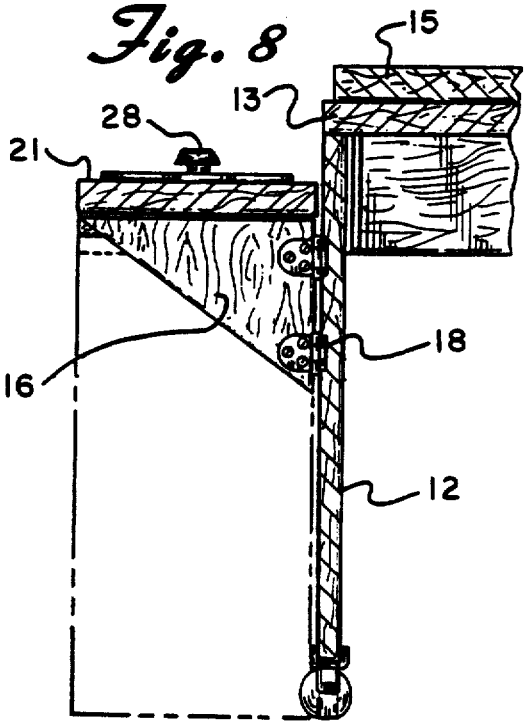
FIG. 8 is a partial rear elevational view showing the swivel panel and work table in erected L configuration.

An alternate design of adapter platform 41 is shown in FIG. 7*a* of the drawings. This alternate form of adapter platform 41 includes an upper panel 42 and two side panels 43 and 44. The upper panel 42 is connected by hinges 45 to the side panel 43. In a like manner, the side panel 44 is connected by hinges 46 to the side panel 43.

The alternate design of adapter platform 41 is of the same height as the adapter platform 34 and is likewise secured in place by a series of dowels 47 in a like manner.

Both the adapter platform 34 and the adapter platform 41, by reason of their hinged connections, are capable of being folded into a flat configuration when not in use for compact storage.

A further modification of the support mechanism for supporting the work table 21 is shown in FIGS. 10–13 of the drawings. This modification includes a door caddie 48. The door caddie is essentially a six sided cabinet with a hinged front door 49. The door caddie 48 is of the same height as the support panel 25.

Figure 10:
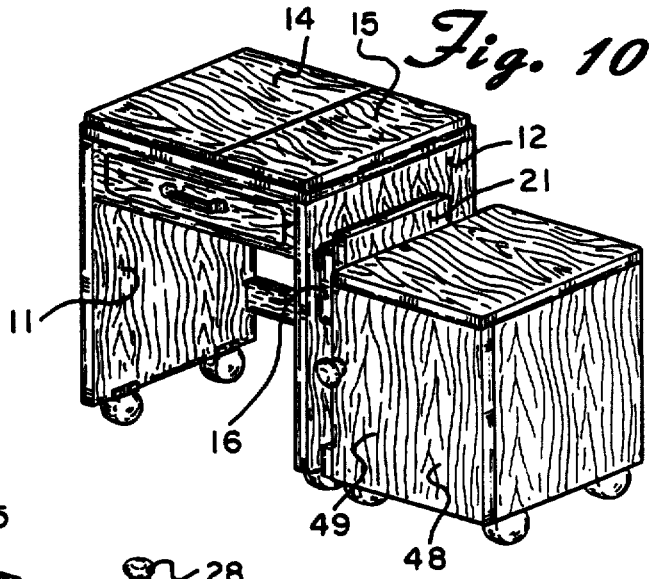
FIG. 10 is a perspective view of the conventional sewing machine cabinet with the swivel panel and work table in stored configuration together with a door caddie in stored configuration.

FIG. 10 illustrates the door caddie and the support panel and associated work surface in folded and stored position. The door caddie 48 can also be stored underneath the sewing machine cabinet between the side panels of the sewing machine cabinet if desired.

Figure 11:
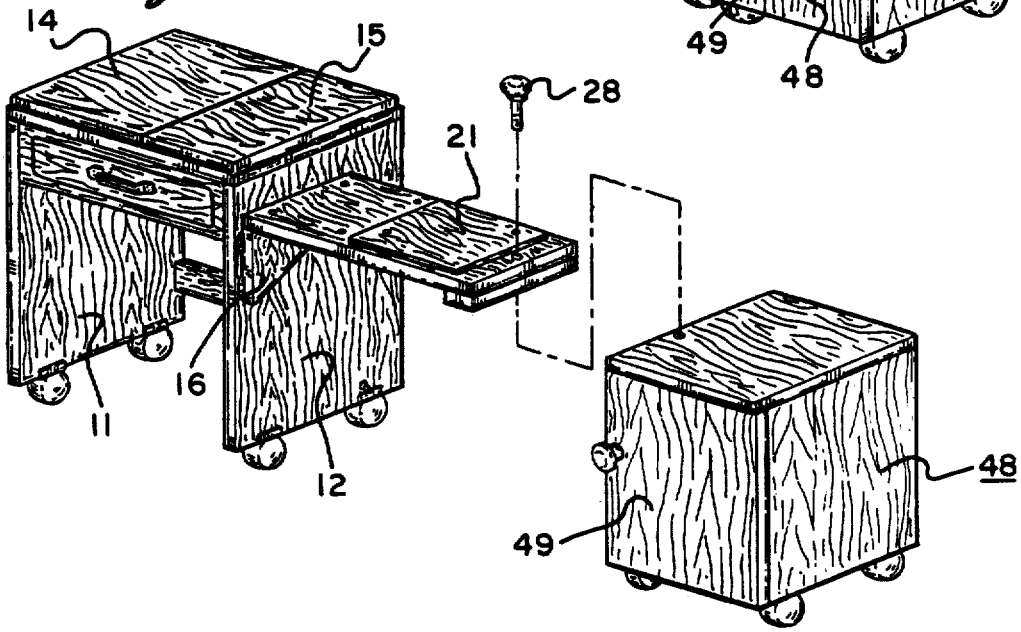
FIG. 11 is a perspective view partially exploded illustrating the swivel panel and work table in erected straight position in relation to the door caddie.
Figure 12:
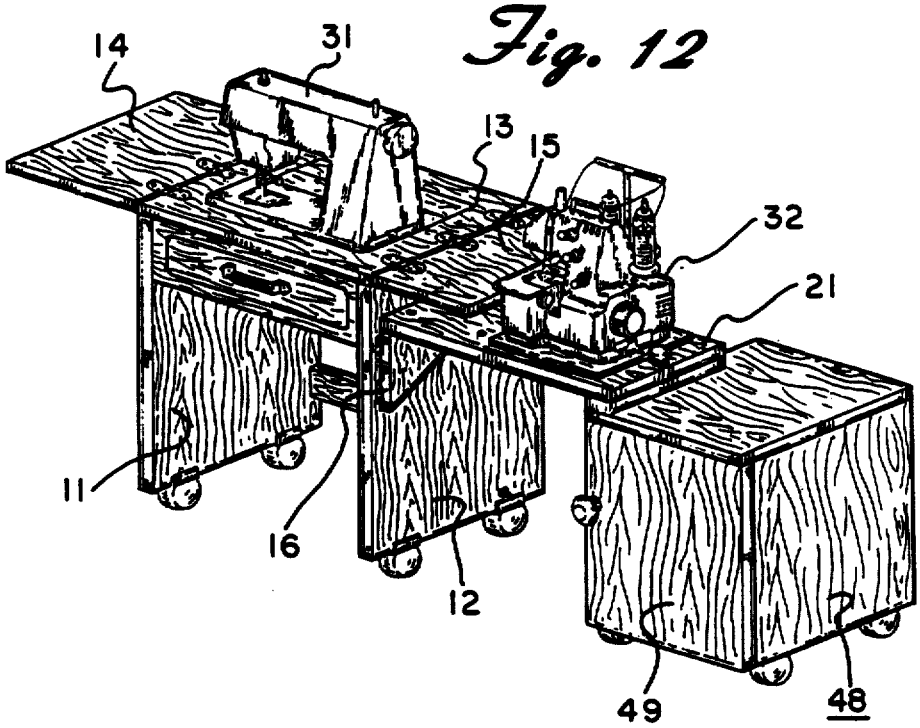
FIG. 12 is a perspective view illustrating the conventional sewing machine in elevated position with the swivel panel and work table erected in straight configuration with the serger in place.

FIGS. 11 and 12 show the swivel panel 16 and work table 21 in the process of being erected (FIG. 11) for straight configuration and in erected position including the conventional sewing machine in elevated position with the associated serger in position (FIG. 12).

Figure 13:
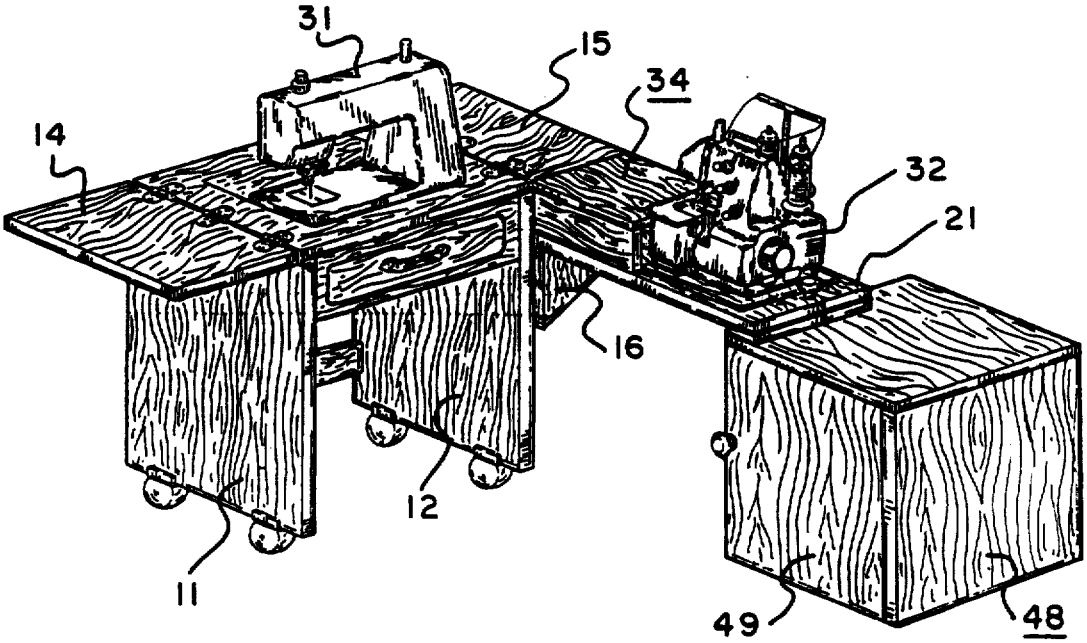
FIG. 13 is a perspective view illustrating the conventional sewing machine in elevated position with the swivel panel and work table in L configuration in conjunction with the door caddie and illustrating the serger machine in place.

FIG. 13 illustrates the swivel panel and associated work table 21 working in conjunction with the door caddie 48 in L configuration. In this configuration as shown in FIG. 13, the adapter platform 34 or alternate adapter platform 41 may also be used as shown in FIG. 13.

When the swivel panel 16 and work table 21 are in folded down configuration as shown in FIG. 10, the door caddie 48 may be used to store the serger and the adapter platform.

Figure 14:
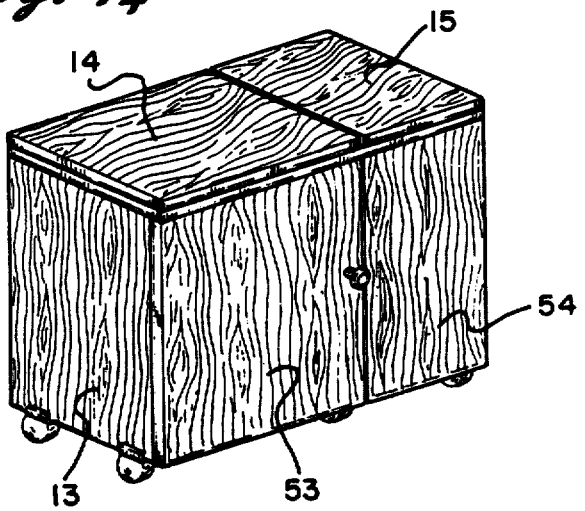
FIG. 14 is a perspective view of an alternate form of sewing machine cabinet with front doors in stored configuration.
Figure 15:
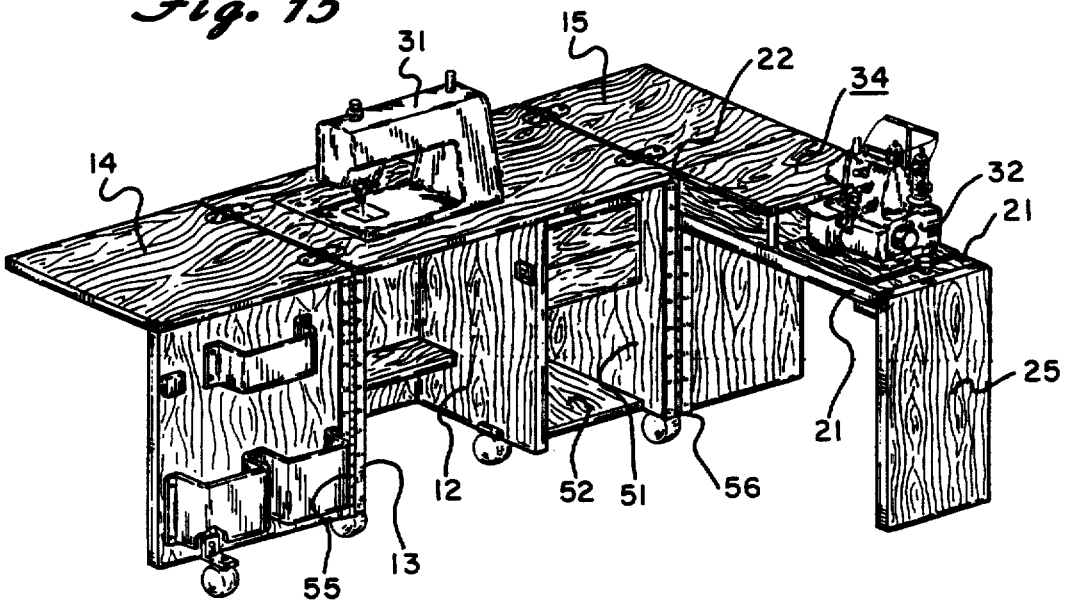
FIG. 15 is a perspective view of the alternate form of sewing machine cabinet with the conventional sewing machine in raised position and the swivel panel and work table in L configuration further in relationship to the adapter platform and serger machine.

An alternate version of a sewing machine cabinet embodying the principles of the present invention is shown in FIGS. 14 and 15 of the drawings. The alternate version of cabinet still employs the side panels and top panel and conventional mechanism for storing a conventional sewing machine. Additionally, the modified cabinet employs the conventional foldout cabinet leaves as illustrated in FIGS. 14 and 15 of the drawings.

The alternate design of sewing machine cabinet is modified, however, to include a third side panel 51, bottom panel 52 and a rear panel (not shown) to provide a cabinet to the right of the cabinet space within which the conventional sewing machine is stored. Further in accordance with the modified cabinet of the present invention, a pair of front doors 53 and 54 are provided. The front door 53 is connected to the left side panel 13 by means of a piano hinge 55 and provides a closure for that portion of the sewing machine cabinet within which the conventional sewing machine is stored. In a like manner, the front door 54 is secured to the additional side panel 51 by means of a piano hinge 56 and provides the closure for the cabinet formed by the additional side panel 51, floor 52 and back panel.

In accordance with the modified sewing machine cabinet of the present invention, the work table 21 is hinged at its first end 22 upon the inside surface of the front door panel 54. In this manner, the front door panel 54 becomes the equivalent of the swivel panel 16 used in the prior embodiments.

When the embodiment of the sewing machine cabinet of FIGS. 14 and 15 is not in use, the serger 32 and adapter platform 34 are removed and stored within the cabinet. Thereafter, the work table 21 is detached from the support panel 25 and permitted to fold down against the inside surface of the front door panel 54. In this condition, the front door panel may be closed and the sewing machine cabinet placed into the closed and stored position with the conventional sewing machine in lowered position and the cabinet leaves closed as shown in FIG. 14.

FIG. 15 illustrates the modified embodiment of sewing machine cabinet with the door 54 swung the the L configuration, the work table 21 raised to elevated position and attached to the support panel 25. In this configuration, the adapter platform 34 is utilized as shown in FIG. 15.

If the modified embodiment of sewing machine cabinet of the present invention is desired to be used in the straight configuration, then the adapter platform 34 is removed and the work table 21 swung around into straight configuration as in the prior embodiments described as respects the straight configuration. The piano hinge 56 is of a design that will permit movement of the front door panel 54 from straight position all the way through L position to closed position.

From the foregoing description of the various embodiments of the improvements to sewing machine cabinets of the present invention, it will be appreciated that these improvements provide for a Duo-cabinet of the nature and type that can be broken down into a compact and convenient configuration for storage while, upon erection of the swivel panel and work table, may provide a cabinet for dual machine use in the alternate configurations of L shape or straight configurations with little effort required in the conversion.

The improvements to sewing machine cabinets of the present invention have been described in the specification in respect to specific embodiments thereof as also shown in the drawings. Other variations and modifications of the improvements to sewing machine cabinets of the present invention will therefore become apparent to those skilled in the art and therefore, no limitation as to the scope of the invention was intended by description in respect to those specific embodiments but the scope of the invention is to be interpreted in view of the appended claims.

I claim:

1. In sewing machine apparatus employing a standard cabinet having opposed side panels for storing a freearm sewing machine beneath folded cabinet leaves while in stored position and in elevated position when the cabinet leaves are unfolded, the improvements providing for dual machine usage in alternate straight or L configurations when in erected position and compact storage when in folded position comprising:

a swivel panel secured to one side panel and adapted for swivel motion between a first position parallel to the side panel and a second position perpendicular to the side panel;

a work table secured at one end to the swivel panel and adapted for motion between a folded position inclined downwardly and parallel to the swivel panel and in upright position when perpendicular to the swivel panel; and support means for maintaining the work table in upright position whereby, in the upright position, the work table may be swiveled between straight and L configurations and folded into a compact stored position when in folded position.

2. The sewing machine apparatus of claim 1 wherein the swivel panel is secured to the side panel at a level below the cabinet leaf when in unfolded position and wherein there is further included an adapter platform adapted to be positioned upon the work surface and of height to align with the cabinet leaf to provide additional work space.

3. The sewing machine apparatus of claim 1 wherein the sewing machine cabinet includes a front door panel which acts as the swivel panel.

* * * * *